United States Patent [19]

DeMaris

[11] Patent Number: 4,999,015

[45] Date of Patent: Mar. 12, 1991

[54] HIGH SPEED ROTATIONAL DISPERSION DEVICE USING SHORT SHEAR PATH

[76] Inventor: Elbert E. DeMaris, 405 Calderon, Mountain View, Calif. 94041

[21] Appl. No.: 420,641

[22] Filed: Oct. 11, 1989

Related U.S. Application Data

[63] Continuation of Ser. No. 200,061, May 27, 1988, abandoned.

[51] Int. Cl.[5] ..... B01F 5/06; B01F 5/12

[52] U.S. Cl. ..... 366/176; 366/264; 366/302; 415/157

[58] Field of Search ..... 366/264, 263, 262, 265, 366/302, 165, 176, 142, 136, 137, 159; 415/157, 158

[56] References Cited

U.S. PATENT DOCUMENTS

| | | | |
|---|---|---|---|
| 4,175,873 | 11/1979 | Iwako . | |
| 4,201,486 | 5/1980 | Huebner . | |
| 4,294,549 | 10/1981 | Thompson | 366/176 |
| 4,499,562 | 2/1985 | Campolini et al. . | |
| 4,511,256 | 4/1985 | Karg et al. | 366/165 |
| 4,529,321 | 7/1985 | Berchoux . | |
| 4,534,654 | 8/1985 | Alt | 366/264 |
| 4,610,548 | 9/1986 | Hallet | 366/176 |

*Primary Examiner*—Robert W. Jenkins

[57] ABSTRACT

A plain, circular, high speed rotor, completely covering, and spaced apart from, the end of a thin walled stationary cylinder, forms a short narrow high shear gap. The cylindrical chamber allows fluid axially approaching the central rotor surface to be accelerated radially, to higher speeds over most of the plain rotor, to pass directly through the short shear gap near the rotor periphery. The higher speed fluid in the rotor boundary layer entering the gap excludes free stream turbulence from the high shear region. By adjustments of the gap clearance, one unit with an inch diameter stationary cylinder can dissolve, grind, prepare submicron dispersions, emulsify, mix or pump fluid mixtures at more than three gallons per minute. The gap clearance limits the size of particles passing through the gap without grinding and the force opposing gap spreading controls the intensity of grinding. After grinding is completed the elastic gap may close to the adjusted gap clearance.

45 Claims, 4 Drawing Sheets

HIGH SPEED ROTATIONAL DISPERSION DEVICE USING SHORT SHEAR PATH

This is a continuation of application Ser. No. 07/200,061, filed 05/27/88.

TECHNICAL FIELD

This invention relates to dispersion devices, and more particularly to such devices employing a rotational radial shear for breaking agglomerates in a carrier fluid into a dispersion of ultimate particles.

This invention forms the subject matter of Disclosure Document 150,735 filed May 27, 1986.

BACKGROUND

Heretofore centrifugal pumps have employed a spinning rotor for radially accelerating the pumped fluid. A large rotor spacing permitted maximum flow rate with minimum shear and friction losses. Impeller blades extending from the rotor surface increased the pumping drag. These prior art pumps were laminar flow devices operating at rpms below the turbulent transition speed of the carrier fluid.

Heretofore centrifugal colloid mills employed radial acceleration to force the carrier fluid through an extended shear path. The length of the gap reduced the flow rate and caused friction heating within the bulk carrier, without adding to the shear effect. The resulting higher temperature destabilized the surface complex of the colloid particles increasing the rate of readherence into agglomerates or particle clusters. Heretofore colloid mills employed static or rotating parts with corners, ridges, grooves, pins, vanes or other irregularities which produced turbulance prior to or within an extended narrow flow path thus limiting flow and increasing heating, without increasing the shear intensity. Highest shear forces for effective dispersing are not efficiently produced by promoting turbulence. In the prior art, axial input flow turns abruptly around a sharp corner through the most constricted flow area before diverging radially along the rotor. Ridges, recesses, sharp edges and rotor rotation, near the flow constriction, upset the turning flow to initiate turbulence. Once initiated, turbulence is intensified by tangential shear in the narrow flow over the spinning rotor surface. All of this turbulent fluid, enclosed between the rotor and the adjacent boundary, is pumped over the rotor perimeter. Free stream turbulence dominates flow in the region of highest shear.

The surface energy, which is related to the surface area and, the melting point of the powdered solid, must be overcome by the the shear forces to break down agglomerates to make dispersions of the ultimate particles. Some high melting point and high surface area powders, particularly carbon blacks, are quite difficult to break down into ultimate particle dispersions, especially in water.

OBJECTS

It is therefore an object of this invention to provide a rotational shear dispersion device which generates a true colloid.

It is another object of this invention to provide such a device which breaks down agglomerates in a carrier fluid to a dispersion of ultimate particle size particles.

It is a further object of this invention to provide such a device having short shear path.

It is a further object of this invention to provide such a device which generates minimal heat in the carrier fluid and has a high pumping rate.

It is a further object of this invention to provide such a device having a high intensity shear region with a small shear volume.

It is a further object of this invention to provide such a device which is easy to clean and maintain.

It is a further object of this invention to provide such a device in which the shear gap spacing is adjustable.

It is a further object of this invention to provide such a device in which the rotor spindle is mechanically isolated from the drive device.

It is a further object of this invention to provide such a device in which the rotor spindle does not require a seal.

Briefly, these and other objects of the present invention are accomplished by providing a rotational shearing device which enhances the dispersion of agglomerates within an input flow of carrier fluid. The flow is passed through a rotational shear gap to form an output flow in which the agglomerates have been broken down by fluid shearing into the ultimate particles forming the agglomerates. A flow source provides the input flow of agglomerates within a carrier fluid. A stator having a chamber with an input region at one end and a shearing region at the other, receives the input flow at the input region and guides the input flow to the shearing region. A stator wall having a shearing edge is formed at the shearing region of the stator. A spinning rotor is positioned proximate the shearing region of the stator, with an impeller surface facing the stator and spaced from the shearing edge to form the rotational shear gap. A drive spins the rotor. A stator pump formed by the impeller action of the rotor impeller surface radially accelerates the input flow from the stator through the shear gap for breaking the agglomerates down into the ultimate particles. A rigid frame supports the stator and the rotor for maintaining the spacing of the shear gap.

BRIEF DESCRIPTION OF THE DRAWING

Further objects and advantages of the rotational shear dispersion device will become apparent from the following detailed description and drawings in which.

Figure 1:
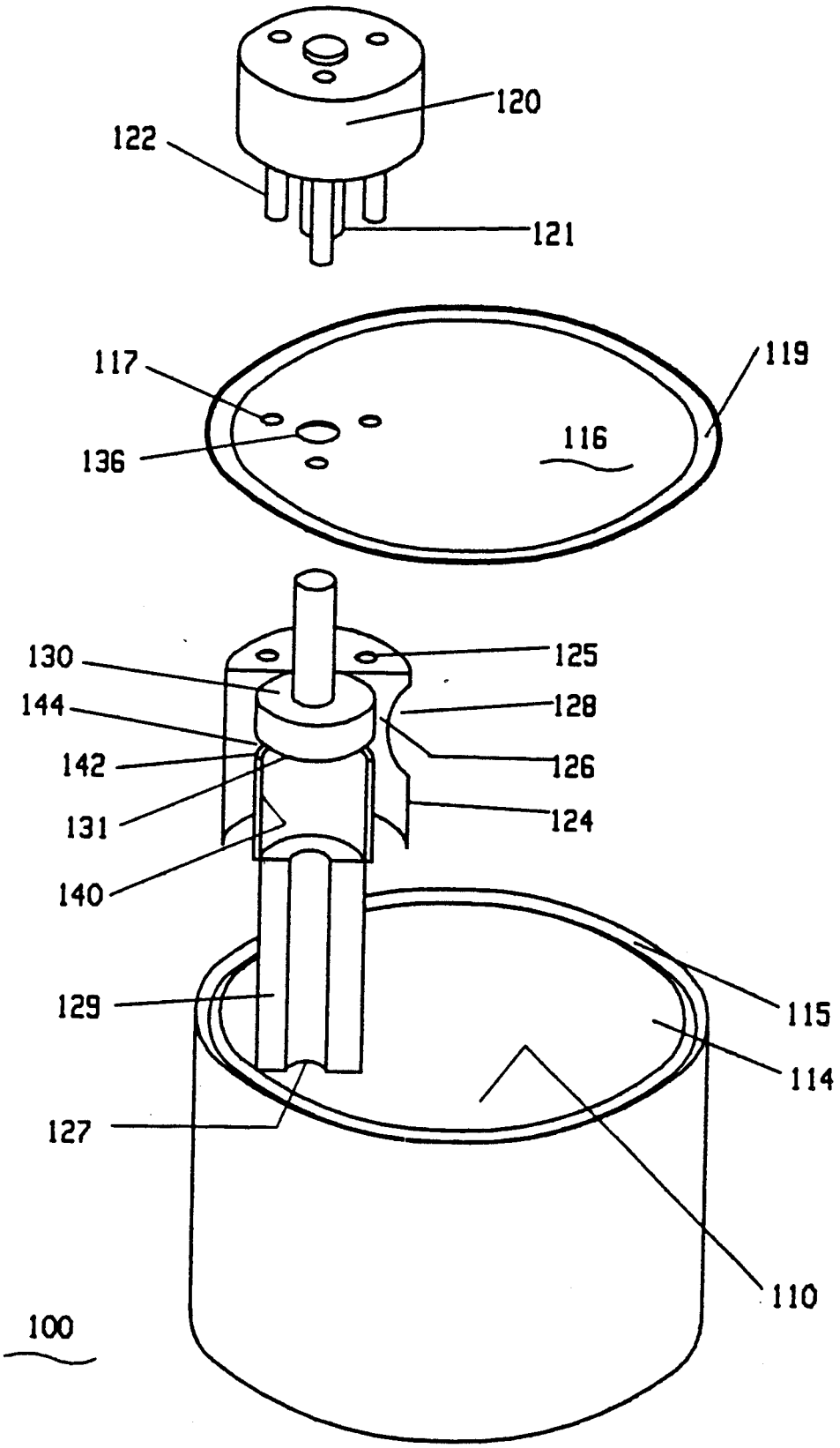
FIG. 1 is an exploded perspective view of a general embodiment of the invention for mixing paint in cans.

Each element of the invention is designated by a three digit reference numeral. The first digit indicates the primary Figure of disclosure. The second and third digits indicate like structural elements throughout the Figures.

ARMATURE MOUNTED ROTOR EMBODIMENT FIG. (1)

Dispersion device 100 disperses agglomerates such as pigments within a liquid carrier such as paint solvents to form a carrier-particle fluid system 110. The solvent-pigment fluid is stored in a suitable reservoir such as paint can 114 sealed by cover member 116. An outer ridge 119 on the cover engages a sealing groove 115 around the top rim of the can reservoir to provide a rim seal which prevents spillage of the paint carrier fluid 110 during the operation of the dispersion device. The rim seal additionally prevents evaporation loss from the can reservoir during storage and operation, and prevents oxidation of the fluid system by air leaking into the reservoir.

Drive motor 120 is mounted to dispersion housing 124 by suitable fastening means such as long frame bolts 122 extending downward from the bottom of the motor, through bolt mounting apertures 117 in the cover member, and engaging mounting holes 125 in the top of the dispersion housing. Armature shaft 121 extends from the drive motor through drive aperture 136 in the cover and connects with dispersion rotor 130.

The carrier-particle fluid enters the dispersion housing through a suitable input port such as pick-up tube 127 extending toward the bottom of the reservoir. A chamber formed by stator 140 at the upper end of the pick-up tube receives fluid 110 and directs the upward flow of the fluid toward the center of impeller surface 131 on the bottom of spinning rotor 130. The carrier-particle fluid is radially accelerated by the impeller action of the rotor and forced through a dispersion gap 144 between the shearing edge 142 of the stator and the adjacent impeller surface. The intense differential shear created across the gap breaks agglomerates of pigment particles into individual (ultimate) particles.

The dispersed fluid from the shear gap enters a peripheral rotor channel 126 formed by housing 124 around the rotor. Output port 128 in the housing returns the dispersed fluid from the peripheral channel to the reservoir. The output port may be directed along the side wall of the reservoir to induce vortex circulation for mixing the paint. A damping vane 129 may be provided on the pick-up tube to limit the vortex movement.

The dispersion device may be self-priming and mounted submerged in the paint fluid permitting the reservoir fluid level to rise into the impeller surface gap area. Alternatively, the dispersion device may be temporarily submerged by lowering the device into the paint fluid or tipping the reservoir container to induce priming.

Operation FIG. 2 A B C and D

Fluid 210 passing through shear gap 244 (FIG. 2A) has a differential velocity which establishes a shear force across the gap for breaking down agglomerates 211 formed by clusters of ultimate particles 212. The velocity of the fluid through the shear gap has a tangential component 214 (see top view FIG. 2B) and a radial component 213 which together form combined velocity 215.

Stator Internal Pumping

The spinning impeller surface functions as a pump within the stator chamber 240 by imparting the rotary or tangential component 214 to the fluid. The resulting centrifugal force within the rotating fluid forms the radial component of motion 213. The fluid is accelerated radially from the center of the impeller outward through the shear gap and into the peripheral rotor channel 226. The fluid passing through the upper region of the shear gap is closest to the spinning impeller surface 231 and therefore is accelerated tangentially and radially the most, and has the highest tangential and radial velocities (see FIG. 2D). The fluid passing through the lower region of the shear gap is furtherest from the spinning impeller and has the lowest velocity.

Channel External Pumping

Figure 2A:
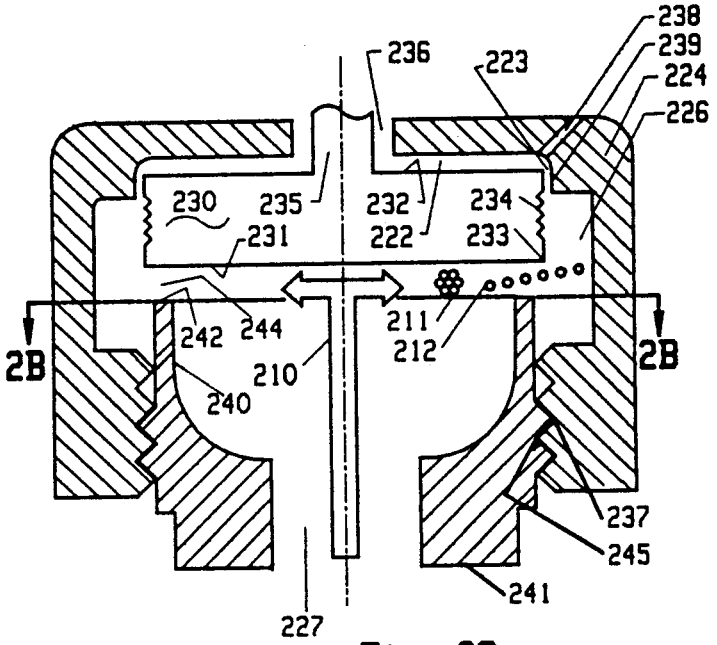
FIG. 2A is a side view in section of a coaxial rotor and stator showing the shear gap therebetween.

The fluid flow into rotor channel 226 is assisted around the channel to output port 228 by the drag of rotating outer edge 233 of rotor 230. The rotational drag contributes to tangential component of velocity within the channel. FIG. 2C shows a line-of-sight view into the gap region from the output port. The tangential component of velocity causes the fluid flow to pass directly through the output port at maximum efficiency without loss of momentum.

The performance of the channel pump is a function of the rotor impeller surface area outside the stator gap and the circumference area and tangential velocity of the rotor drag edge 233. Thick rotor 230 with wide drag edge 233 provides more channel pumping than thin rotor 330 (see FIG. 3) with narrow drag edge 334. However thin rotor 330 has outer rotor portion 333 extending beyond the stator which adds to the channel pumping.

Streamline contours 235 formed by grooves and ridges in rotor edge 233 enhance the rotary drag capability of the rotor by increasing the circumference area of drag edge 233 and increasing turbulence. If the flow conditions exceed the Reynolds number for the fluid, turbulence will be maintained. If the flow conditions are below the Reynolds number, the flow in the rotor channel becomes predominantly laminar and much slower. Turbulent flow near the rotor enhances the drag effect to accelerate the fluid to velocities approaching the rotor surface velocity.

Spindle Pump

Rotor 230 is centrally mounted on spindle 235 extending from back surface 232 of the rotor. The impeller action of back surface 232 maintains rotor back region 222 between the back surface and the housing free of carrier fluid. Some fluid flow bypasses output 228 and enters narrow bypass channel 223 formed between the upper portion of the rotor periphery and inwardly extending portion 239 of housing 224. This bypass fluid cannot enter the back region because of the centripetal pressure generated by the spindle pump surface 232. Preferably, the diameter of the spindle is less than the diameter of the input flow of fluid 210 onto impeller surface 231, giving the spindle pump more rotor surface area for generating radial acceleration.

The bypass fluid cannot escape through spindle clearance 236 at the housing-spindle interface, eliminating the need for a spindle seal. The high rpm requirement of the dispersion device places a service life limitation on conventional mechanical seals. Bypass vent 238 through the housing adjacent to bypass channel 223 and back region 222 insures a continual flow of carrier fluid to minimizes fluid stagnation.

Gap Fluid Flow

Figure 2D:
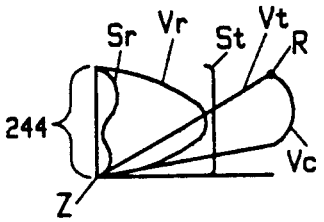
FIG. 2D is a plot of flow velocity and shear against position within the shear gap of FIG. 2A.

The tangential velocity of the fluid flow maintained by the stator pump, increases generally uniformly from the stator region up to the impeller region (see FIG. 2D, curve "Vt"). That is, the tangential velocity gradient is generally constant, resulting in a generally constant tangential shear force (see FIG. 2D, curve "St").

The radial velocity of the fluid flow maintained by the stator pump and the channel pump and the fluid pressure (if any) at stator input 227 and at channel output port 228. A positive pressure head at the input or a negative pressure head (back pressure) at the output will increase the fluid flow, while a negative pressure at the input or a positive pressure at the output will decrease the flow. The radial fluid velocity also increases from the stator region up to the impeller region (see FIG. 2D, curve "Vr"). The resulting radial shear is the first derivative of the radial velocity (see FIG. 2D, curve "Sr").

The combined fluid flow is determined by the combined effect stator pump, the channel pump, and the external pressure heads. The lower most fluid adjacent to the stationary stator edge 242 forms a zero velocity film (see FIG. 2D, point Z); and the upper most fluid adjacent to the spinning impeller forms a rotor velocity film (see FIG. 2D, point R).

Dispersion Formation

Figure 2B:
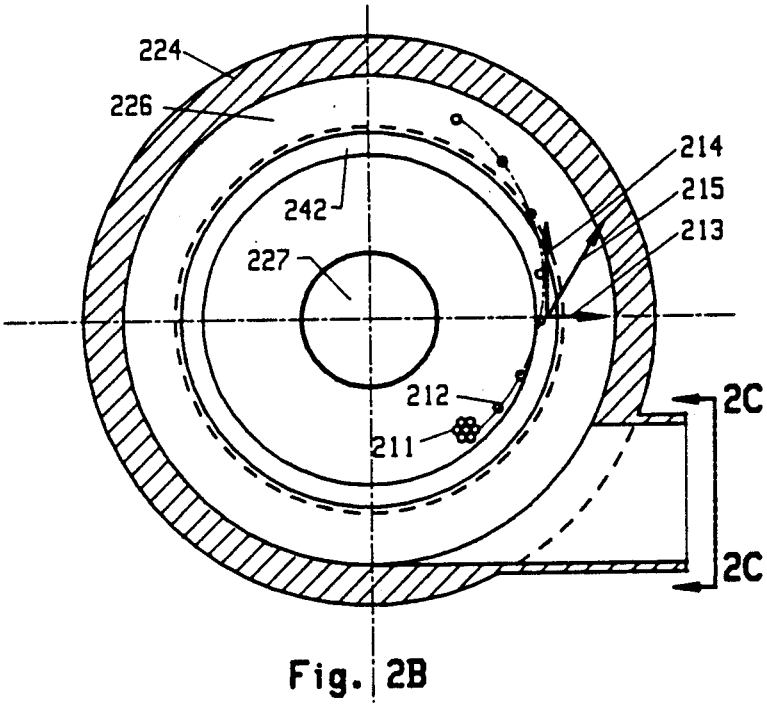
FIG. 2B is a view along lines 2B of FIG. 2A showing the combined velocity and shear within the gap.
Figure 2C:
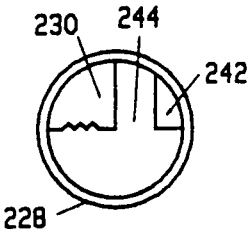
FIG. 2C is a view along lines 2C of FIG. 2B showing the line-of-sight into the output port.

Each agglomerate 211 passing through the shear gap experiences a tangential carrier flow velocity along the its upper surface which is greater than the tangential carrier flow velocity along its lower surface. The larger the particle, the greater is the top to bottom velocity differential or shear force thereacross. When the flow shear force across an agglomerate exceeds the critical shear force, the agglomerate breaks down into ultimate particles to form a colloidal dispersion. The critical external shear force overcomes the internal particle to particle surface adhesive forces holding the cluster of ultimate particles together. The upper particles of the sheared agglomerate speed away from the lower particles forming a sequence of separated ultimate particles 212. The dispersion effect of the radial shear force is shown in FIG. 2A, and the effect of the tangential shear force is shown in FIG. 2B.

The critical shear force is determined by the size chemical composition and physical structure of the agglomerate, the adhesive forces, size of the particles forming the agglomerate, the temperature of the system, and the nature of the liquid carrier.

Dispersion Stability

The dispersed particles will remain dispersed or return to the agglomerate form depending on the stability of the dispersion. In general, the more complete the agglomerate breakdown and the finer the ultimate particles, the slower settling is the resulting dispersion. The intense shear across gap 244 causes maximum breakdown into ultimate particles.

Gap Spacing

The spacing between rotor impeller surface 231 and stator shearing edge 242 defines shear gap 244 and determines both the effectiveness of the dispersion action and the volume of the fluid flow. Narrow gaps provide a more intense shear at a lower fluid flow with more frictional heat generation than larger gaps at the same rotational speed. A typical dispersion operation involves shear gap spacings thousands of times greater than the agglomerate diameter. Most agglomerates break down to ultimate particles with diameters thousands of times smaller than the gap spacing of the dispersion device. A typical shear rate for the dispersion device is in can be in excess of 1,000,000/inches/inch second.

Smaller shear gaps approaching the diameter of the agglomerate produce secondary dispersion by abrasion through mechanical impact in addition to the primary dispersion produced by the intense fluid shear field. This secondary dispersion effect is caused by inter-agglomerate collision in the narrow gap which knocks the agglomerates apart into smaller sub agglomerates and ultimate particles.

Gaps smaller than the diameter of the agglomerates produce grinding and crushing in addition to the shearing and inter-agglomerate impact. The agglomerates are broken down mechanically by the impeller surface and the shearing edge due to constriction compression during the gap passage. At a zero shear gap, the stator shearing edge is in direct contact with the rotor surface The gap spacing may be increased or decreased by increasing or decreasing the spacing between stator edge 242 and the impeller surface on rotor 231. In the embodiment of FIG. 2 this adjustment is accomplished by displacing the stator position with respect to the housing and the rotor. External stator threads 245 engage internal housing threads 237. The shear gap may be increased or decreased by the turning stator within the housing. The stator is accessible for turning along base 241 which extends outside of the housing. The stator threads seal the stator-housing interface.

Preloading for an Elastic or Rigid Gap

Clearance play in the thread interface and end play in the rotor shaft are stabilized during operation to control the way they affect the dynamic gap spacing. The rotor is mechanically biased away from the stator by the force of the fluid flow from stator input 227 against rotor impeller surface 231. The high fluid pressure within the stator during operation preloads or presses the rotor to the end play position furthest from the stator, the maximum gap position.

Figure 3:
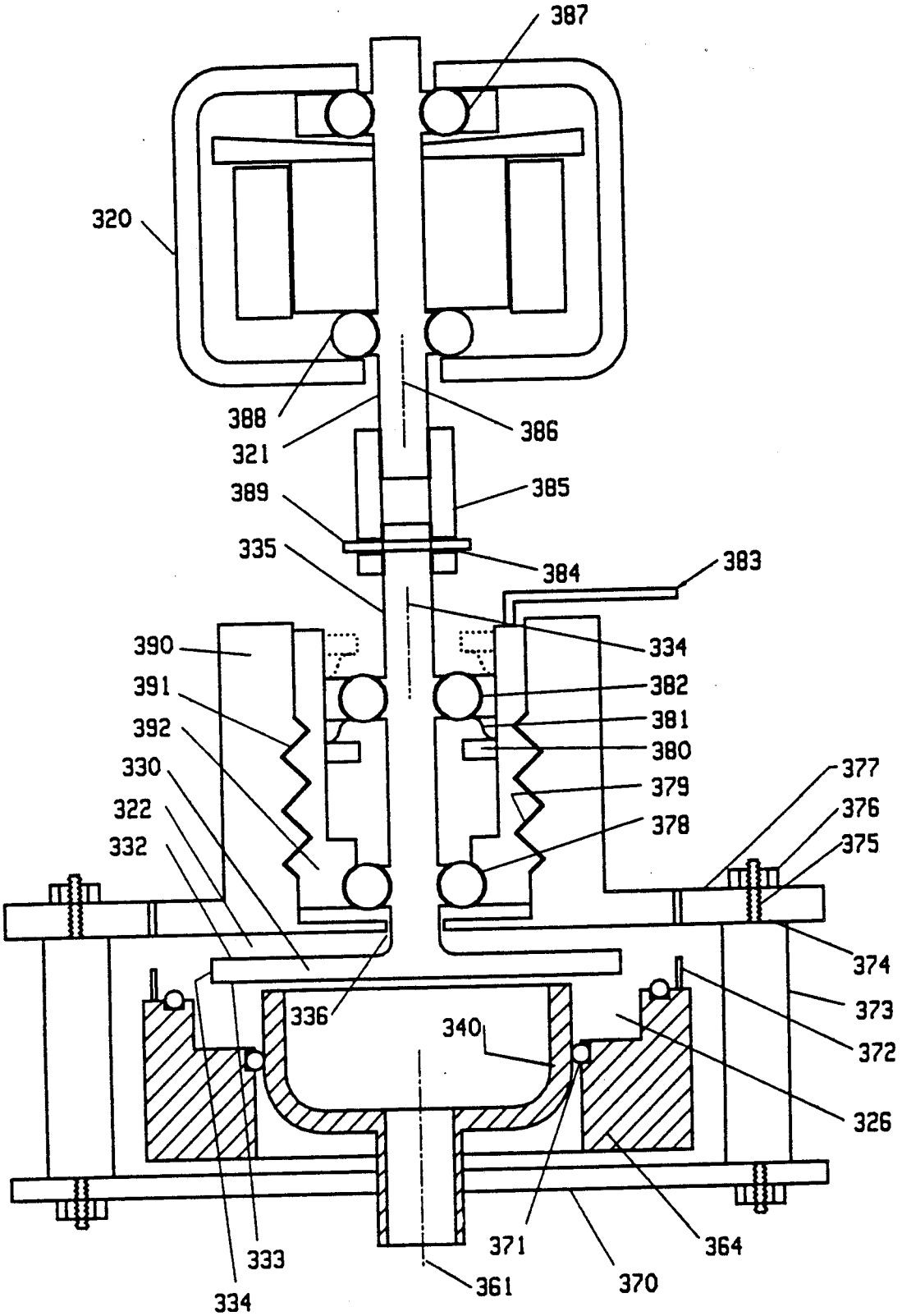
FIG. 3 is a sectional side view of a rotor isolated from the drive motor.

A spring bias member may be employed to independently preload the rotor (see FIG. 3, spring washer 381) either toward maximum gap per FIG. 3 or minimum gap by relocating spring washer 381 so that it presses on the opposite side of bearing 382 forcing it toward the stator. Minimum gap preloading permits temporary gap spreading to pass hard oversize secondary particles such as diamond dust in the input fluid flow without damage to the unit. The minimum preloaded gap is elastic to provide a uniform grinding of particles so they fit within the fluid passing through the shear gap. In the embodiment of FIG. 3, spring member 381 cooperates with the fluid flow to assist the preload thrust force during operation towards maximum gap that is essentially rigid. Preloading provides a dynamic steady state operating position of the rotor which damps rotor vibration and maintains a more uniform shear gap during operation.

Gap Access

The shear gap adjustment in the embodiment of FIG. 3 is accomplished by displacing the rotor with respect to the stator. External threads 379 on rotor cage 392 engage internal threads 391 on rotor housing 390. The shear gap may be increased or decreased by turning the rotor cage by means of adjusting lever 383. A pitch of 20 threads per inch provides a gap change of over ten mils per quarter turn of the lever.

Gap access sufficient for insertion of a feeler gauge is established by drop housing 364 mounted between rotor housing flange 377 and stator housing flange 370. The housing flanges are rigidly secured together by a suitable securing device such as plurality of free studs 373. The ends 375 of the free stud are threaded and extend through the housing flanges and engage flange nuts 376. The body portion of each free stud provides an end shoulder 374 for supporting the housing flanges. The drop housing may be slid away from the rotor toward stator flange 370 into the access position to expose the shear gap as shown in FIG. 3. Guide means such as index pins 327 extending from the drop housing engage the rotor flange when the drop housing is in the operation position. Housing "O" rings 371 seal the flange-housing interface and the stator-housing interface during operation.

Rotor back region 322 must be large enough to receive the rotor at the largest space settings of the shear gap. Large gap settings permit more fluid flow with a higher pressure at the output and at the entrance to back region 322. This pressure is balanced by the decreased width of back region 322 to prevent leakage around spindle interface 336 in spite of the larger shear gap settings.

ISOLATED ROTOR EMBODIMENT (FIG. 3)

Rotor spindle 335 may be mechanically isolated from armature shaft 321 to prevent rotor end play (axial and radial displacements) from affecting the shear gap spacing. The embodiment of FIG. 3 shows a two part shaft with a suitable rotational coupler such as resilient flexible tube 350. Armature shaft 321 extending from motor 320 engages the drive or armature end of the coupling tube 385. Rotor spindle 335 engages the load or rotor end of the tube 385.

The inner bore of the coupling at the armature end is slight smaller then the diameter of the armature shaft to provide a secure fit sufficient to support the rotational coupling.

The inner bore of the coupling at the rotor end is slightly greater than the rotor spindle diameter permitting the coupling tube to accommodate end play in the armature shaft. As the armature shaft "floats" or otherwise changes position during operation, the coupling makes corresponding displacements relative to the smaller rotor spindle by slipping back and forth along the spindle. The coupling tube is secured to the rotor spindle by a suitable fastening means such as rotor retaining pin 389 which extends through the end of the rotor spindle and engages a pair of retaining holes 384 in the rotor end of the coupling tube. The holes in the coupling tube are larger than the diameter of the retaining pins to permit armature shaft displacement independent of the rotor spindle.

The rotor end play is stabilized by preloading the rotor bearings by a suitable spring biasing structure such as spring washer 381. In the embodiment of FIG. 3, the rotor is spring biased into the maximum gap end play position toward the motor and away from the stator by the force of washer 381 against flange 380 extending from rotor cage 392 and against the sliding bearing race containing bearing 382. The maximum gap preloading of the washer cooperates with the thrust loading by the input fluid flow to prevent axial displacement of the rotor during operation. The longitudinal end play in the armature shaft is determined by the design tolerance, bearing wear and thermal expansion during operation.

The shear gap is additionally isolated from the motor end play because the coupling tube is resilient and accommodates limited compression and tension forces caused by the changing distance between the armature shaft and the rotor spindle. Motor vibrations are attenuated by the resilience of the coupling tube. The coupler also functions as a torque limiting device between the motor and the rotor spindle. An overload in the dispersion work load will cause retaining pins 389 to rip through the coupling material at the thin cross section adjacent to each retaining hole 384. Because of the high rpm of the motor, most operating torque requirements will be minimal.

Shaft Alignment

The orientation of rotational axis 386 for armature shaft 321 is defined by the motor mounting and more particularly by position of the front and rear armature bearings 338 and 387. The orientation of the rotational axis 334 for rotor spindle 335 is maintained fixed by front and rear rotor bearings 378 and 382. The orientation of the axis of symmetry 361 for stator 340 is fixed within housing 324.

The directional play of the armature shaft is determined by the design tolerance and wear of the armature bearing surfaces. The rotor spindle and shear gap spacing are isolated from the directional orientation of the armature shaft because the coupling tube is flexible and permits limited misalignment between the armature shaft and the rotor spindle. The axis of rotation of the rotor spindle need not be perfectly directionally aligned or exactly collinear with the axis of rotation of the motor armature.

Figure 4:
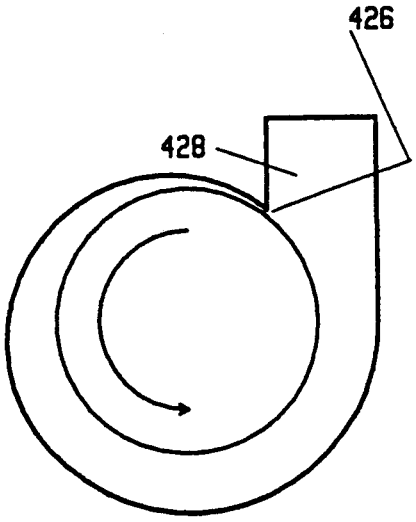
FIG. 4 is a sectional plan view of a snail type rotor housing showing the tangential flow and the outlet.
Figure 5:
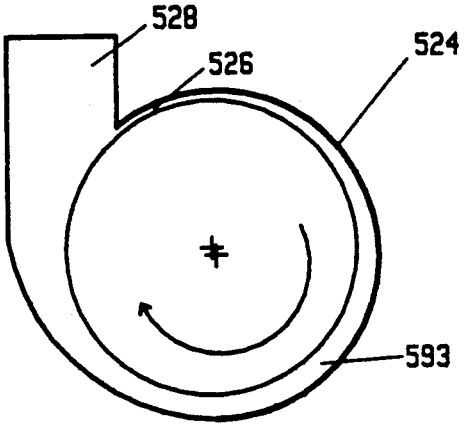
FIG. 5 is a sectional plan view of an offset type rotor housing.

Rotor Channel Cross Section (FIGS. 4 and 5)

The rotor channel is the distance between the rotor drag edge and the rotor housing, and directs the dispersed fluid flow to the housing output port. The rotor housing may be concentrically located around the rotor (see FIG. 2B) forming a uniform cross section rotor channel. Alternatively, an "snail shell" housing (FIG. 4) or eccentric axis configuration (FIG. 5) may be employed which form rotor channels with non-uniform cross sections.

Snail shell housing 424 provides a rotor channel which increases as the distance around the channel flow to outlet port 428 decreases. The rotor spin and channel flow are shown as CCW in the embodiment of FIG. 4. The narrowest cross section 426 of the rotor channel is located just after the outlet port (downflow) in the CCW direction, for directing away the rotating boundary layer adjacent the rotor into the exit flow. The largest channel cross section is located just before the outlet port. Preferably, the output port extends radially from the housing (orthoganol to the flow) for most effectively receiving the tangential fluid flow within the channel. An output port 428 extends tangentially from the rotor channel for receiving tangential fluid flow with minimum resistance.

In the embodiment of FIG. 4 the cross section of the rotor channel increases linearly in the CCW direction to accommodate the increasing volume of fluid flow from the shear gap. The linear increase permits the each segment of flow to maintain a generally constant tangential velocity around the rotor channel, regardless of the point of entry of that segment from the shear gap. The uniform cross section of the concentric rotor channel of FIG. 2 produces a fluid flow around the channel with a linearly increasing tangential velocity.

Housing 524 is positioned off center from the axis of rotor providing a narrow channel cross section portion 526 and a corresponding wide channel cross section portion 593. Housing output port 528 is position even with or just downflow from the CW flow through the wide cross section.

MULTIPLE CHANNEL OUTPUT PORTS (FIG. 6B)

The channel housing may have a plurality of output ports for more efficiently removing the fluid flow from the rotor channel. Housing 624 has two output ports (see FIG. 6B) on opposite sides of the rotor, which minimize the back pressure within the channel. The double output ports reduce the increasing tangential velocity caused by the uniform channel cross section.

Figure 6B:
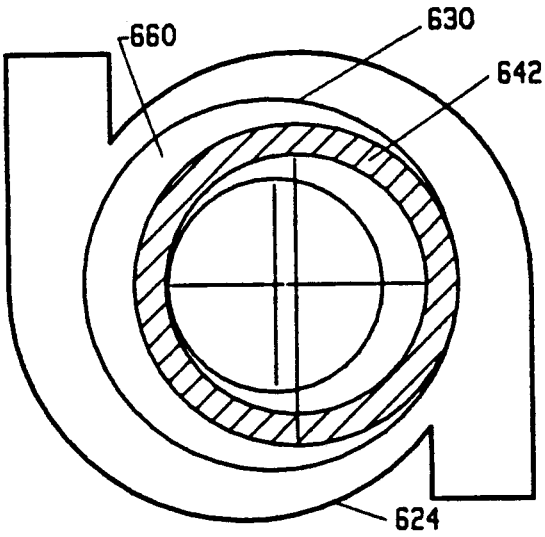
FIG. 6B is a view along lines 6B of FIG. 6A.
Figure 6A:
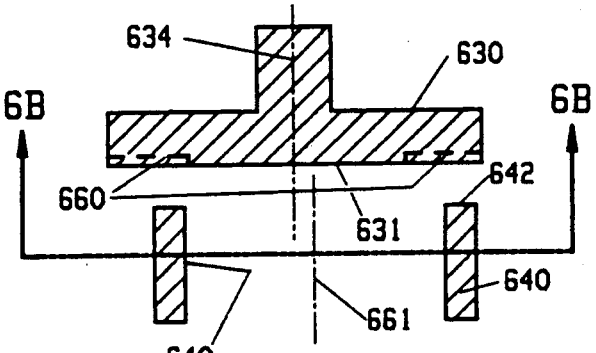
FIG. 6A is a sectional side view of an offset stator and rotor with a wide wear path.

Wide Wear Path (FIG. 6A and 6B)

The rotor axis of rotation may be collinear with the stator axis of symmetry (see FIG. 3). The periphery of rotor 334 is concentric with stator shearing edge 340 establishing a simple concentric ring path of stator wear against the impeller surface of the rotor. Alternatively, a non aligned stator-rotor configuration may be employed such as shown in FIG. 6A and 6B. The axis of symmetry 661 of stator 640 is offset slightly with respect to the axis of rotation 634 of rotor 630. The stator wear path of on impeller surface 631 of the rotor is a series of overlapping rings forming a wider ring 660 (dashed lines). The wear on the rotor surface is spread over a greater area in the non-aligned case of FIG. 6, than in the aligned case of FIG. 2. The wider ring path 660 provides a corresponding longer wear life with less flow restriction as the wear progresses.

Figure 7:
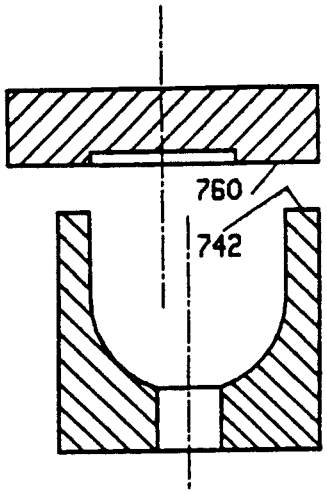
FIG. 7 is a sectional side view of a rotor with a raised impeller surface having extended service life.

Raised Impeller Surface (FIG. 7)

The wear region on the rotor impeller surface may be flush with the remainder of the rotor surface (see FIGS. 2A and 6A); or raised as shown in FIG. 7. Rotor wear edge 760 extends closer to stator edge 742 to provide extended wear of the rotor. After a short initialization period the two wearing surfaces become closely matched.

SPECIFIC EMBODIMENT

The following particulars of the dispersion device are given as an illustrative example of complete and reproducible dispersion of agglomerates into ultimate particles. The high surface area of the ultimate particles effectively promotes the desired characteristic of the substance. Complete dispersion produces more pigment effect, higher flavor etc for the same amount of dispersed material.

Carbon Black

Carbon has a high surface energy and traditionally has been difficult to disperse into a carrier fluid such as water. The present dispersion device using a 0.6 inch radius rotor operating at about 20,000 rpm, with 2 mil gap spacing and a 60 mil path length, reduced carbon agglomerates having a diameter of several hundred microns into ultimate crystal particles having a diameter of 2 to 30 nanometers. The resulting diffuse gel of non-settling stable pigment particles was 15% carbon by weight and 85% water by weight with a gravy like consistency.

Masonry Paint

An electrically stabilized dispersion of white cement in water produced a masonry paint which drys in a hard dense layer. The dispersion was formed by 10 parts cement, 85 parts water, and 5 parts lime (for raising the ph). Prior art masonry paint was typically flocculated during the mixing and produced a fluffy layer of low density.

Rotor Speed

The rotor speed is one determinate of the velocity gradient and shear gradient across the shear gap. High speeds produce a high shear rate which overcomes the critical shear force to provide effective dispersion of the agglomerates. The stator pump force and pregap pressure is also a function of rotor speed. The input fluid in the stator is radial accelerated through the shear gap by the impeller surfaces. A high fluid removal rate or input restriction will cause a drop in the fluid pressure within the stator. If this internal stator pressure drops below the vapor pressure of the carrier fluid, the fluid will cavitate within the stator resulting in vapor lock of the dispersion device. A rotor speed of from about 10,000 rpms to about 25,000 rpms generally provides sufficient shear force without cavitation.

The smooth face of the rotor does not induce additional turbulence thereby allowing a thicker rotor velocity film to develop inside of the stator. The large clearance between the surface of the rotor, within the stator, and the nearest static surface allows an additional increase in the thickness of the rotor velocity film by reducing shear rates and the turbulence intensity in the fluid adjacent to the rotor.

The thicker rotor velocity film and adjacent fluid travel at much higher tangential and radial velocities into and through the gap to produce the high flow and the intense shear affect of this invention. The rotor velocity film and more adjacent fluid travel into, through, and out of the narrow gap along a plain path leading to the peripheral channel. The rotor velocity film and more adjacent fluid travel in the peripheral channel another smooth path leading into the exit port. It has been observed that the high flow rates of this invention are achieved along radially and circumferentially streamlined flow boundaries and through a short narrow gap.

Unique flow response of this invention to the gap clearance significantly increases the performance and versitility. Surprisingly, the highest fluid velocity through the gap occurs at smaller gap settings. The volume of flow through this invention increases to a maximum as the gap clearance is initially increased. However, further gap increase will reduce the volume of flow. Adjustment of gap clearance converts this invention from a pump to: a mixer, disperser, homogenizer, grinding mill and back to a pump, as desired, by adjusting the gap clearance.

Additionally, large amounts of wear during operation can be compensated for, without replacement of parts, for a prolonged service life. Plain Gap surfaces on the rotor and stator allow precise clearance measurement.

Industrial Applicability

It will be apparent to those skilled in the art that the objects of this invention have been achieved by providing a rotational shear dispersion device which generates a true colloid with an indefinite suspension shelf life. The device breaks down agglomerates in a carrier fluid to a dispersion of ultimate particle size particles by passing the carrier fluid through a short shear path. Heating of the bulk fluid is minimal due to the short shear path. The high rotational speed of the rotor plus the combined pumping capacities of the stator pump and the channel pump provides a high pumping rate. The gap separation is small to maintain a high intensity shear region therein with a small shear volume. The device is easy to clean and maintain because of the cylindrical construction and the access to the interior. The shear gap spacing is adjustable to control the shear intensity by moving the relative position of the stator or rotor. Mechanical isolation is provided between the rotor spindle and the drive device by a resilient connector.

From the foregoing it will be evident that the constructions disclosed make it possible for one device to produce dispersions, emulsions and solutions rapidly and of reproducible quality in volumes of less than 100 milliters to 50 liters or more.

The efficiency of the operation is not influenced by the volume of the resevoir, the depth of the fluid nor the quantity of material being processed when the volume of the material is greater than the internal volume of the invention with a recycle tube.

No vapors or dusts of the materials being processed are emitted into the surrounding atmosphere.

Very limited, if any, of the surrounding atmosphere is drawn into the fluids being processed, even at the very high operating speeds.

The rotor with spindle can be; an integral part of the motor shaft or, a very short independant shaft for dynamic stability. This invention encloses the high speed parts to protect them and contain them for safety.

The clearance can be reduced and the speed of rotation increased to intensify the shear and deliver more energy to the agglomerates and particles or immiscible fluid being dispersed or even ground. Initially, dry powders or immiscible liquids can be rapidly incorporated into the bulk fluid at maximum flow gap clearance to form coarse mixtures. Thereafter by reducing the gap clearance the mixture can be processed to the desired degree of dispersion while simultaneously transferring it to another resevoir or individual containers. Dispersions of reproducible quality can be prepared in a single unit, thus reducing equipment and processing costs.

This invention accomplishes mixing, dispersing and grinding without immersing moving parts in the resevoir of fluid or location the drive motor over or immediately adjacent to the reservoir of fluid. Accidental operation or transfer of fluid is averted by the necessity of priming of the invention for it to pump fluid.

Clearly various changes may be made in the structure and embodiments shown herein without departing from the concept of the invention. Further, features of the embodiments shown in the various Figures may be employed with the embodiments of the other Figures. The offset stator feature of FIG. 6 with the wide wear path may be combined with the extended impeller surface feature of FIG. 7 to provided an even more prolonged service life.

Therefore, the scope of the invention is to be determined by the terminology of the following claims and the legal equivalents thereof.

I claim as my invention;

1. A rotational shearing device for enhancing the dispersion of agglomerates within in an input flow of carrier fluid by passing the input flow through a rotational shear gap to form an output flow in which the agglomerates are broken down by fluid shearing into the ultimate particles forming the agglomerates, comprising:

flow source means for providing the input flow of agglomerates within a carrier fluid;

stator means having a chamber therein with an input region and a shearing region, the input region having an flow input means for receiving the input flow from the flow source means and guiding the input flow to the shearing region;

stator wall means forming the shearing region of the stator means;

a shearing edge formed along the end of the stator wall means;

spinning rotor means positioned proximate the shearing region of the stator means, having an impeller surface facing the stator means and spaced from the shearing edge to form the rotational shear gap therewith;

drive means for spinning the rotor means;

stator pump formed by the impeller action of the rotor impeller surface which radially accelerates the input flow from the stator means through the shear gap which breaks the agglomerates down to the ultimate particles; and rigid frame means with adjusting means supporting the stator means and the rotor means for establishing and maintaining the spacing of the shear gap.

2. The rotational shearing device of claim 1, wherein the rotor means is preloaded against the frame means towards maximum shear gap into a stable operating position.

3. The rotational shearing device of claim 1 further comprising gap adjusting means has threaded means to provide precise control of the spacing of the shear gap.

4. The rotational shearing device of claim 3, wherein the gap adjusting means is between the frame means and the stator means and displaces the stator means with respect to the frame means and the impeller surface.

5. The rotational shearing device of claim 3, wherein the gap adjusting means is between the frame means and the rotor means and displaces the rotor means with respect to the frame means and the stator means.

6. The rotational shearing device of claim 3, wherein the rotor means is thrust loaded against the frame means into a stable operating position by the input flow of the carrier fluid.

7. The rotational shearing device of claim 6, wherein the thrust load is toward maximum shear gap.

8. The rotational shearing device of claim 3, further comprising a resilient means for preloading the rotor means against the frame means into stable operating position.

9. The rotational shearing device of claim 1, further comprising:

flow output means proximate the shear gap for passing the accelerated flow the carrier fluid and ultimate particles therein out of the shearing device.

10. The rotational shearing device of claim 9, further comprising:

housing means around the shear gap for defining a rotor channel which directs the accelerated flow the carrier fluid and ultimate particles therein to the flow output means.

11. The rotational shearing device of claim 10, wherein the flow output means is a plurality of output ports formed in the housing means.

12. The rotational shearing device of claim 10 further comprising:

gap access means for permitting access to the shear gap to measure the spacing between the shearing edge of the stator means and the impeller surface.

13. The rotational shearing device of claim 12, wherein the housing means shifts in position to provide access to the shear gap through the gap access means.

14. The rotational shearing device of claim 13, further comprising:

indexing means between the housing means and the frame means for defining the operating position of the housing means.

15. The rotational shearing device of claim 1, wherein the stator axis of symmetry is offset slightly from the rotation axis of the rotor means for increasing the width of the shear wear path on the spinning impeller surface proximate the stator shearing edge.

16. The rotational shearing device of claim 15, wherein the offset of the stator axis of symmetry is generally equal to the thickness of the stator wall means.

17. The rotational shearing device of claim 1, further comprising:

flow output means proximate the shear gap for passing the accelerated flow of the carrier fluid and ultimate particles therein out of the shearing device;

housing means around the shear gap for defining a rotor channel which directs the accelerated flow to the flow output means.

18. The rotational shearing device of claim 17, wherein the housing means is round defining a housing center axis which is collinear with the axis of rotation of the rotor means to provide a rotor channel of uniform cross-section.

19. The rotational shearing device of claim 17, further comprising a channel pump means formed by the rotating edge surface about the circumference of the rotor means which drags on the flow within the rotor channel for further accelerating the flow the carrier fluid and ultimate particles therein to the flow output means.

20. The rotational shearing device of claim 19, wherein the output flow means aligned with the rotating edge surface to receive a tangential flow from the housing means without loss of tangential flow momentum.

21. The rotational shearing device of claim 19, wherein the rotor channel has a non-uniform cross-section and the portion of the rotor channel with the largest cross-section is positioned upstream from the flow output means for facilitating the output flow, and the portion of the rotor channel with the smallest cross-section is positioned downstream from the flow output means for skimming of the rotor edge boundary layer into the output flow.

22. The rotational shearing device of claim 21, wherein the housing means is round defining a housing center axis which is offset from the axis of rotation of the rotor means to provide the channel of non-uniform cross-section.

23. The rotational shearing device of claim 1, further comprising:

housing means around the shear gap and the rotor disc for defining a rotor channel which contains the dispersed fluid flow from the shear gap;

channel pump means formed by the surfaces along the edge around the circumference of the rotor disc which accelerates the dispersed fluid flow from the shear gap around the rotor channel;

flow output means in the housing means for receiving the accelerated fluid flow in the rotor channel; and spindle pump means formed by the peripheral surface of the drive side of the rotor disc which accelerates the fluid flow in the rotor channel away from the rotor spindle.

24. The rotational shearing device of claim 23, wherein the diameter of the rotor spindle is less than the diameter of the input flow of fluid against the rotor disc.

25. The rotational shearing device of claim 23, further comprising:

vent means in the housing means near the spindle pump.

26. The rotational shearing device of claim 1, further comprising:

drive shaft extending from the drive means;

spindle extending from the rotor means; and isolation means connecting the drive shaft to the spindle for coupling the torque from the drive shaft to the spindle while mechanically isolating the spindle from the drive shaft.

27. The rotational shearing device of claim 26, wherein the isolation means is a resilient and flexible.

28. The rotational shearing device of claim 27, wherein the resilient and flexible isolation means is a tube means having a drive end which fits over the drive shaft and having an opposed rotor end which fits over the spindle.

29. The rotational shearing device of claim 28, wherein the isolation tube means is a failure element for protecting the rotor from the drive means.

30. The rotational shearing device of claim 27, wherein the isolation means provides a pivotal connection between the drive shaft and the spindle for permitting limited misalignment between the axis of rotation of the drive shaft and the axis of rotation of the spindle.

31. The rotational shearing device of claim 1, wherein the stator wall means is round with an outside radius overlying a major length of the rotor radius.

32. The rotational shearing device of claim 1, wherein the rotor means further comprises:

a plain circular rotor having an impeller side and a drive side with a streamlined surface formed on the impeller side;

and a rotor spindle coaxially extending from the drive side of the rotor for connecting the rotor to the drive means.

33. A method of enhancing the dispersion of agglomerates within an input flow of carrier fluid, comprising the steps of:

providing flow source for the input flow of agglomerates within a carrier fluid;

providing stator means which receives the input flow at one end with a shearing edge formed along the other end;

providing a spinning rotor means with an impeller surface positioned proximate the shearing edge of the stator means forming an adjustable rotational shear gap therewith;

radially accelerating the input flow by the impeller action of the rotor surface;

passing the accelerated input flow through the rotational shear gap to form an output flow in which the agglomerates are broken down by fluid shearing.

34. The method of claim 33 comprising the additional step of preloading the rotor in the maximum gap position by the pressure of the input flow against the impeller surface.

35. The method of claim 33 wherein the shear gap is set to a spacing much larger than the dimension of the agglomerates in the carrier fluid.

36. The method of claim 33 wherein the shear gap is set to a spacing approaching the dimension of the agglomerates in the carrier fluid.

37. The method of claim 33 wherein the shear gap is set to a spacing less than the dimension of the agglomerates in the carrier fluid and approaching the dimension of the ultimate particles forming the agglomerates in the carrier fluid.

38. The method of claim 33 wherein the shear gap is set to a spacing less than the dimension of the ultimate particles forming the agglomerates in the carrier fluid.

39. The method of claim 33 comprising the additional step of yieldingly loading said rotor to define the minimum shear gap clearance to form an elastic shear gap wherein the elastic shear gap is set to a spacing less than the dimension of the agglomerates to grind while dispersing.

40. The method of claim 39 wherein the elastic shear gap is set to a spacing less than the dimension of the ultimate particles forming the agglomerates to grind while dispersing.

41. A method of enhancing the rate of dissolving soluble particles within an input flow of solvent, comprising the steps of: providing flow source for the input flow of soluble particles within a fluid solvent, per the method of claim 40, forming an output flow in which the soluble particles are finely dispersed for becoming completely dissolved in said solvent at a rate directly related to the exposed particle surface area.

42. The method of claim 40 wherein the yieldingly loading force is adjustable, thereby controlling grinding compression and shear intensity in the elastic shear gap.

43. A method of enhancing the emulsifying of droplets of immiscible fluid within an input flow of carrier fluid, comprising the steps of: providing flow source for the input flow of droplets of immiscible fluid within a carrier fluid, per the method of claim 33, forming an output flow in which the droplets of immiscible fluid are broken down by fluid shearing into an emulsifyed dispersion of fine droplets.

44. The method of claim 33 comprising the additional steps of:

containing all of the particles and agglomerates to be dispersed in the stator chamber;

receiving an input flow of carrier fluid from the flow source at one end;

accelerating the carrier fluid with included particles and agglomerates by the impeller action of the rotor surface.

45. A method of pumping fluid per claim 33 comprising the additional steps of:

supplying the fluid to be pumped to the flow source;

receiving gap output flow in the housing enclosing the gap output;

accelerating the gap output flow tangentially in the rotor channel within said housing by channel pumping;

directing the accelerated channel flow to the flow output;

wherein the gap spacing is set to the clearance providing pumping at the desired rate of output fluid flow.

* * * * *